US007377709B2

(12) United States Patent
Butler

(10) Patent No.: US 7,377,709 B2
(45) Date of Patent: May 27, 2008

(54) ANTIMICROBIAL HAND SANITIZER AND WRITING PEN

(75) Inventor: Richard S. Butler, Lake Worth, FL (US)

(73) Assignee: JMB Trading Co., Inc., Lake Worth, FL (US)

( * ) Notice: Subject to any disclaimer, the term of this patent is extended or adjusted under 35 U.S.C. 154(b) by 264 days.

(21) Appl. No.: 11/104,904

(22) Filed: Apr. 12, 2005

(65) Prior Publication Data

US 2006/0228155 A1 Oct. 12, 2006

(51) Int. Cl.
*B05C 1/00* (2006.01)
*B43K 27/02* (2006.01)
*B43K 29/00* (2006.01)
*A46B 11/02* (2006.01)

(52) U.S. Cl. ..... 401/195; 401/17; 401/18; 401/188 R

(58) Field of Classification Search ..... 401/195, 401/52, 188 R, 188 A, 17, 18, 19, 20, 23, 401/29

See application file for complete search history.

(56) References Cited

U.S. PATENT DOCUMENTS 4,221,490 A 9/1980 Malm
4,244,525 A 1/1981 Manna
4,600,327 A 7/1986 Guzman
4,673,007 A * 6/1987 Huang ..... 141/95
4,786,197 A 11/1988 Koeln et al.
D321,717 S 11/1991 Hager
5,340,227 A * 8/1994 D'Andrade ..... 401/195
5,620,113 A 4/1997 Meshberg
5,667,104 A 9/1997 Meshberg
D396,884 S 8/1998 Davila
5,938,359 A 8/1999 Kim
5,938,363 A 8/1999 Timms et al.
6,152,634 A 11/2000 Kim
6,179,504 B1 1/2001 Jones
6,234,357 B1 5/2001 Lewis
6,283,334 B1 9/2001 Mahaffey et al.
6,554,516 B1 4/2003 Christopher

* cited by examiner

*Primary Examiner*—David J. Walczak
(74) *Attorney, Agent, or Firm*—McHale & Slavin, P.A.

(57) ABSTRACT

A combination writing instrument and hand sanitizer including a cartridge containing a mechanical finger pump at a first end and a retractable pen nib at a second end. The cartridge contains an effective antimicrobial hand sanitizer solution therein which is readily dispensed by the finger pump. The writing instrument is useful for personnel in the healthcare industry and food industry where if function both as a device for recording information and a hand sanitizer.

11 Claims, 2 Drawing Sheets

ANTIMICROBIAL HAND SANITIZER AND WRITING PEN

FIELD OF THE INVENTION

This invention relates to a device for providing convenient containment and dispensing of an antimicrobial agent, and particularly to a combination device which is further useful as a writing implement.

BACKGROUND

It has been widely reported that the spread of infectious diseases by the hands of healthcare, caregiver or even food service personnel is a serious issue. As a result of this problem, the U.S. Center for Disease Control (CDC) has issued healthcare guidelines to the food service industry. CDC recommends the use of 60-70% alcohol in antibacterial hand sanitizing products. CDC estimates that each year some 2 million patients acquire nosocomial infections (infections acquired while a hospital patient). Also, it was estimated that well over 100,000 deaths in 2000 were due to nosocomial infections. Food service personnel are often responsible for cross-contamination leading to food borne illness. It is estimated that over 70 million people will have a non-fatal case of food infection.

As noted above, CDC has taken the initiative to promote hand washing guidelines to the healthcare industry. Studies by CDC have led to the conclusion that healthcare or food service personnel do not wash their hands at all, or only use minimal hand sanitizing. Hand sanitation is the core of the problem, and also the least expensive remedy to this vexing issue. Yet it has been reported that hand washing compliance does not exceed 40%, even in hospitals. Based upon the information shown above, the present inventors believe that providing an effective antibacterial spray in combination with a reliable ball point writing pen, represents a viable means for promoting hand sanitation compliance. Supplying this device to healthcare and food industry personnel, (as well as any other industry) will provide a convenient way for such personnel to have, on their person and ready for immediate use, an effective antimicrobial hand spray (AMHS) in the form of an easy to carry, useful and ergonomically friendly writing pen.

PRIOR ART

U.S. Pat. No. 6,152,634, discloses a writing instrument having a sanitary moistener. The device includes an elongated body having a writing tip at one end and a supply of moistening liquid accessible at a location on the body of the instrument by a finger of an individual using the instrument, in order to moisten the finger to facilitate turning sheets of paper. The moistening liquid is supplied in a reservoir and delivered by a pump, or through a finger-operated valve. Alternatively, the moistening liquid is supplied in a liquid retaining porous medium having a part which can be exposed through an opening in the body of the instrument. In one embodiment, the liquid-retaining medium is accessible at the end of the instrument opposite to the writing tip. In two embodiments, the liquid-retaining moistener has conical passages receiving the ink cartridge and a side projection received in an open-ended slot in one of two parts constituting the body of the instrument. The moistening liquid preferably includes a bactericide to prevent the spread of germs. The writing instrument taught by the '634 patent, is similar to the instantly disclosed invention, in that an ink pen having a liquid container for storing sanitizing liquid is disclosed. A finger pump mechanism is provided for dispensing the sanitizing liquid from the container to some form of applicator medium, in which it becomes encumbered, and from which it may be applied, e.g. by rubbing, touching, blotting or the like. However, the '634 patent fails to teach or suggest any embodiment wherein an unencumbered bactericidal fluid is applied directly to a surface, such as the user's skin, for the purpose of sanitizing.

U.S. Pat. No. 5,938,363, discloses a lotion dispensing device which includes a lotion dispensing body with a central interior cavity dimensioned to receive replaceable lotion cartridges. The lotion is dispensed from the dispensing device by a piercing dispensing orifice member which includes a piercing flow tube and roller ball spreader applicator assembly which is threadably secured to the dispensing end of the dispensing body of the device. The device also includes a cover member with a retaining clip. The device is dimensioned and constructed similar to a ball point pen and/or marking pen and is easily carried in accessible locations by a user such as a plumber, mechanic and/or machinist. The '363 patent fails, however, to disclose a device which is capable of a dual utility, as instantly disclosed.

U.S. Pat. No. 6,179,504, discloses a combination lotion dispenser and pen. The device includes a housing having a truncated upper end, an arcuate lower end and a tubular intermediate portion therebetween. The truncated upper end has an internally threaded recess formed therein. The arcuate lower end has an elongated bore extending inwardly thereof. A pen cartridge is removably received within the elongated bore. A bulbous rubber container is coupled with respect to the housing. The container has a threaded extension disposed on a lower end thereof for coupling with the internally threaded recess of the truncated upper end of the housing. The container has an opening through an upper end thereof. The opening has a cap removably coupled therewith. The container has a dispensing hole within a side wall thereof whereby lotion within the container will dispense outwardly thereof upon squeezing of the container. The patent fails to teach or suggest dispensing an antimicrobial hand spray therefrom.

U.S. Des. Pat. No. D396,884, discloses an ornamental design for a combination writing instrument and correcting fluid device.

U.S. Pat. No. 2,354,402, discloses a mechanical feed pencil having a plurality of compartments formed therein adapted for receiving various articles necessary for rendering first aid. For example, the compartments may include bandages, antiseptic solution, medicinal preparations etc. The compartments are arranged as separate sections adapted for assembly into a unit.

U.S. Pat. No. 4,244,525, discloses a writing instrument with refillable scent dispenser. The device includes an elongated housing having a recess for retaining the writing implement and a closed bottom annular chamber surrounding the recess. The annular chamber serves to hold a liquid such as a perfume or cologne. A pump including a plunger and an associated spray nozzle is mounted in the open top of the annular chamber. Reciprocating motion of the plunger varies the pressure within a pump chamber to draw liquid into the pump chamber and to expel it through the nozzle. The instrument may be used for writing or for dispensing the liquid scent. The patent fails to disclose dispensing an antimicrobial containing agent.

U.S. Pat. No. 4,600,327, discloses a writing instrument which has an ink applicator at one end and a hollow cylindrical reservoir at the opposed end containing a correction fluid. A first cap member is removably received on the instrument to cover the ink applicator when not in use and a second cap member is removably received on the opposed end of the instrument to enclose the reservoir. A fluid applicator brush is secured in the second cap and has a depending portion which is removably received within the reservoir in a stored position when the second cap is in place. The patent fails to disclose dispensing an antimicrobial containing agent.

U.S. Des. Pat. No. 321,717, discloses an ornamental design for a combined ball-point pen and correction fluid applicator.

U.S. Pat. No. 6,554,516, discloses a writing instrument with a retractable ink cartridge and retractable correcting fluid cartridge mounted on opposite ends. Actuators on the barrel of the writing instrument would extend or retract the writing or correcting tool desired. The correcting fluid end incorporates a sealed aperture to keep the correction fluid from drying out. The patent fails to disclose dispensing an antimicrobial containing agent.

U.S. Pat. No. 6,234,357, discloses a dispenser arrangement which allows various cleansing or sanitizing products to be carried on the body of a user, or mounted at other convenient locations. The dispenser arrangement includes a product container, and a holster device adapted to carry the product container. Typically, the product container will be carried in the holster device in an inverted orientation. The holster device includes mounting structure, such as a mounting clip, which attaches to the clothing of a user. An adapter element may be provided so that the holster device can be mounted, via the mounting structure, to a stationary surface. Preferably, the holster device is specially configured so that only a small portion of the product container's outer surface is obstructed. Often, the product to be dispensed will be a viscous liquid, such as soap, waterless hand cleaner, waterless hand sanitizer or skin lotion. A dispensing pressure applied to the flexible sidewall of the product container causes the viscous liquid to be dispensed. The patent fails to disclose a combination device for dispensing an antimicrobial containing agent and simultaneously providing a writing instrument.

Mahaffey, U.S. Pat. No. 6,283,334, discloses a personal dispensing system which allows various cleansing or sanitizing products to be carried on the body of a user. Often, the product to be dispensed will be a viscous liquid, such as soap, waterless hand cleaner, waterless hand sanitizer or skin lotion. A dispenser made according to the invention includes a product container having a mounting element, such as a mounting clip, located thereon. In many cases, the mounting element will be oriented such that the product container will be inverted when worn on the body of a user. In addition, the mounting element may be removable from the product container so that a new product container can be substituted when the contents of a prior product container are depleted. According to another advantageous aspect of the invention, multiple product containers of different types may be used with a common mounting element. Various interlocking arrangements are contemplated to effect the removable securement of the mounting element to the product container. The patent fails to disclose a combination device for dispensing an antimicrobial containing agent and simultaneously providing a writing instrument.

The present invention thus satisfies a long felt need for a combination device which provides a sprayable sanitizing hand spray in combination with a useful writing instrument. The present invention also provides a leak-resistant, spill-resistant and child-resistant container for the antimicrobial containing agent.

SUMMARY OF THE INVENTION

The purpose of this invention is to provide people in various industries, including, albeit not limited to, healthcare personnel (doctors, nurses, aides, anyone associated with sick people), food service personnel and the like, with a means for applying antibacterial protection, which is also useful as a writing instrument. To perfect the antimicrobial pen instrument, it was necessary to provide an effective antimicrobial, e.g. an antibacterial solution, within a particularly designed plastic tube powered by a mechanical finger actuated spray pump. The pen portion of the instrument contains the ball point pen unit at one end, followed by its ink reservoir, and an open ended round plastic sheath that covers roughly 80% to 85% of the antibacterial tube. The antibacterial solution is activated by twisting the actuator to the center position exposing the spray orifice. When spraying for the first time, the pump must be primed by pressing the actuator down 2 or 3 times. Once primed, the pump will dispense a metered 120 mcl dose of solution with each actuation. After use, the actuator is twisted to the left or right to its locked position. In this position, the unit is incapable of accidentally dispensing liquid while being carried in a pocket, purse, etc. The pen unit is activated by rotating a gripping portion of the pen barrel just above the pen writing point. The grip may be rotated in either a clockwise or counterclockwise direction relative to the remainder of the barrel, such that when the grip is rotated in either direction relative to the barrel, the writing element will be advanced to the writing position, and when the grip is rotated in the opposite direction relative to the barrel, the writing element will retract.

DETAILED DESCRIPTION OF THE INVENTION

Figure 1:
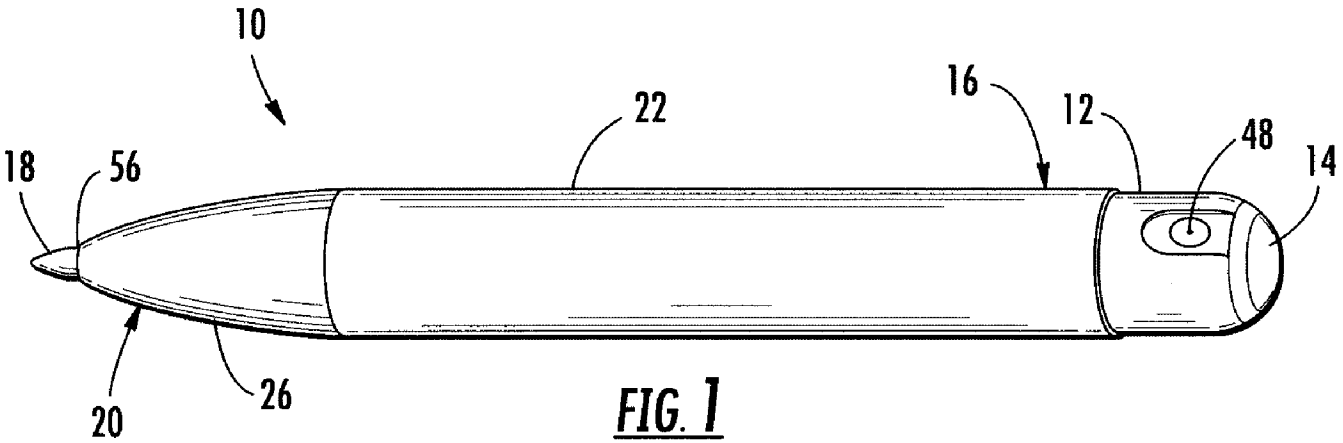
FIG. 1 is a front view of the instant invention, illustrated with the twist-lock spray actuator in the unlocked position and the pen nib in an extended position.

Referring to the embodiment exemplified in FIGS. 1-4, a preferred embodiment of the antimicrobial hand sanitizer and writing instrument 10 is shown. In general, an effective antimicrobial hand sanitizer solution is incorporated in a removable and replaceable solution cartridge 12 containing a mechanical finger actuated pump 24 (FIG. 4) at a first end 16, together with a retractable pen nib 18 at a second end 20, thereby providing a device for dispensing biocidal protection to healthcare and other personnel in the form of a useful writing implement. The cartridge 12 containing the antibacterial solution extends throughout a large portion of the barrel 22, culminating in a twist-lock spray actuator 14 at its furthest end. Healthcare and other personnel attending sick people, and concerned with protection against bacterial infection, or to prevent cross-contamination to other patients, can now kill 99.9% of the microbes on their hands by virtue of an easy to carry writing instrument. This is accomplished with two full sprays to the palm of one hand, and then briskly rubbing the palm and fingers of both hands together for a very short period of time. The treated hands will almost instantly become dry, smooth and silky clean.

By inverting the device, the healthcare worker, food industry worker, or layman can twist a grip portion 26 of the barrel 22 extending a pen nib 18 to write prescriptions, patient orders, exam results or reports, without seeking wash facilities or antibacterial hand sanitizing solutions that are out of immediate reach. The increased hand sanitizing compliance attainable with the instant invention will decrease cross-contamination and food-borne illness.

The antibacterial hand sanitizer solution used in this instrument has been tested against viable bacterial organisms with a kill rate of 99.9%.

This invention relies on three common components:

(1) a finger actuated mechanical pump 24 securely connected to its liquid holding tank 28;

(2) a premium ballpoint pen nib 18 with a small reservoir of writing ink; and (3) an effective antimicrobial hand sanitizer (AMHS) solution.

Of the three components listed above, it is preferable that the pump 24 and its liquid holding tank 28 be molded from a plastic resin, such as polypropylene, for example. The ball point pen nib 18 and its open extended barrel 22 may be molded from a variety of plastic and/or metal materials. Since some degree of rigidity is required, it is suggested that likely plastic resins for use in the instant invention will be polypropylene, high density polyethylene, and acetal resins such as CELCON or DELRIN. Suggested metals include steel, stainless steel, brass, bronze and aluminum.

The non-aerosol, mechanical, finger actuated pump 24 is widely obtainable, for example it may be purchased worldwide from manufacturers such as Precision Valve Co., Yonkers, N.Y., Seaquist Perfect Dispensing Inc., Cary, Ill., Emsar Inc., Stratford, Conn., and Valois, Inc., Brookfield, Conn. For persons acquainted with the art, finger actuated pumps are well known and accepted universally. In order to operate the pump, it must be first primed with the AMHS solution before a consistent metered spray dose can be delivered. This is typically achieved by depressing the twist lock actuator 14 several times when in the open spray position in order to remove the air from the pump body or holding chamber. The depression of the actuator moves the stem 30 downward which, in turn, depresses the piston 32. These events cause a vacuum to be created inside the holding chamber 34 allowing the AMHS liquid product to flow into the pump chamber 36 on the upstroke. Once primed, the pump is sealed and the liquid AMHS product is dispensed as a metered spray through nozzle 48, with each subsequent actuation.

It should be noted that a further object of this invention is to have a twist lock actuator 14 with a spray position and at least one, and more preferrably two, locked position(s). Since the device is constructed for attachment to a shirt, blouse, or the like hanging from a pocket or even stored in a pocket, it is essential that the AMHS solution not leak. It is a required condition that the pump be inactivated when not in use. The twist-lock spray actuator 14 includes a key 38 which is constructed and arranged to cooperate with keyway 40. Alignment of the key and key-way permits operation of the spray actuator. Turning the spray actuator a small amount prevents inadvertent operation of the spray actuator. Therefore, while the pump twist lock is normally in the locked (no spray) position, just a simple flick of the actuator 14 turns the actuator to the open (spray) position.

Figure 4:
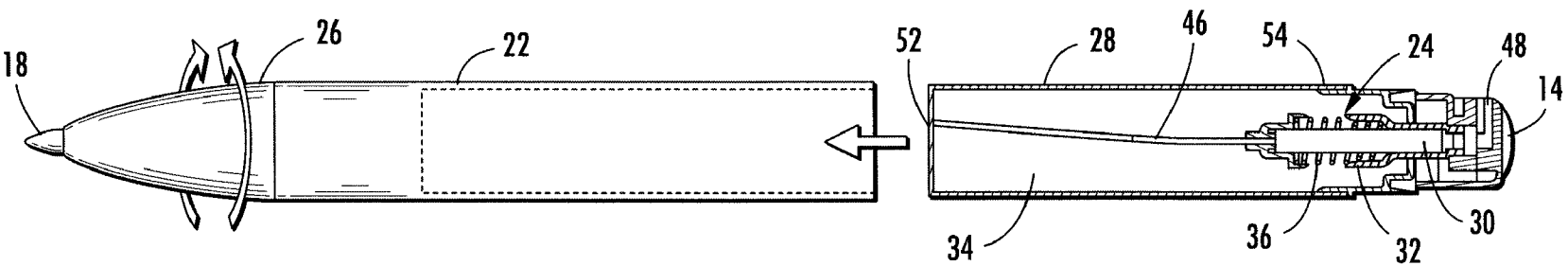
FIG. 4 is a partially exploded view of the instant invention, illustrating a section view of the antibacterial cartridge taken along lines 1-1 of FIG. 3.

It is a specified object of this invention that the AMHS spray be used with seconds after the hands are contaminated or soiled with potential paathogenic bacteria. As noted above, this invention contains a liquid holding tank with a capacity of 9.0 to 11.0 ml (0.33 FL.OZ.). It is assumed that the holding tank 28 can be slightly tapered with the smallest diameter at the bottom end 42 thereof and gradually becomes larger as it proceeds to the top end 44. As can be seen in FIG. 4 the outer diameter of the holding tank is approximately the same as the inner diameter of the barrel such that the outer diameter of the holding tank frictionally engages the inner diameter of the barrel.

Figure 3:
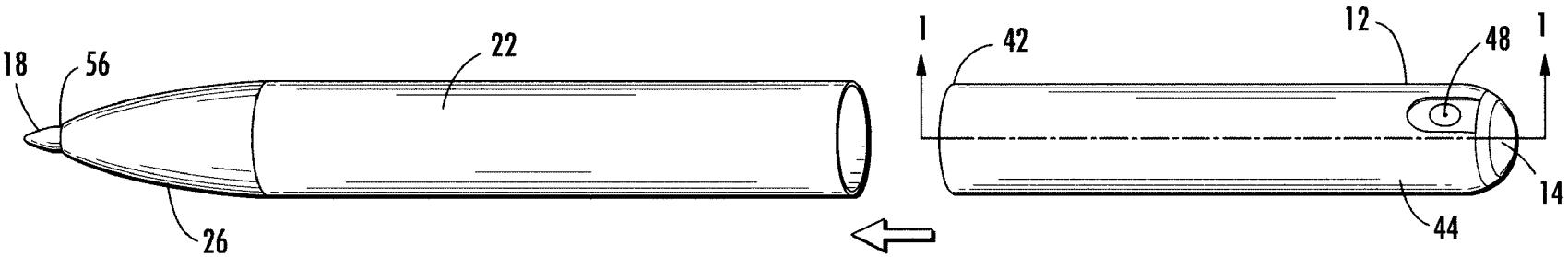
FIG. 3 is a partially exploded view of the instant invention.

With reference to FIGS. 3 and 4, an illustrative, albeit non-limiting example of a holding tank 28 is shown. The holding tank includes a closed end 52 and an open end 54. The AMHS liquid holding tank, once filled, is securely closed with the pump 24 that houses the twist lock actuator 14 on top, and a transport dip tube 46 from the end of the pump housing to the bottom of the holding tank. The purpose of the plastic dip tube is to transport the liquid AMHS up through the pump holding chamber 34, up through the stem 30, out from the spray actuator 14 and finally to the hands. It is standard practice that the bottom of the dip tube have a notch or slant cut. This allows for the liquid AMHS solution to be more completely evacuated from the liquid holding tank.

Still referring to FIGS. 3 and 4, the finger pump 24 is shown securely in place with its twist lock actuator 14 at the top. The dip tube 46 is connected to the bottom of the holding chamber 34 and extends to the bottom of the liquid holding tank 28. The pump 24 is designed to snap into or onto the holding tank containing the liquid AMHS solution, to form a non-leaking secure fit.

As noted above, the effectiveness of the AMHS solution is critical to the functioning of the invention. For purposes of this invention, the terms antimicrobial and antibacterial will be used synonymously.

A non-limiting example of a suitable AMHS solution is manufactured by Packaging Concepts Assoc., LLC, Boynton Beach, Fl., hereinafter referred to as PCA. The PCA—Antibacterial Hand Spray (ABHS) solution is registered with the FDA as an over-the-counter (OTC) drug product. The preferred embodiment of the PCA-ABHS solution contains 60-70% ethyl alcohol as the prime active ingredient. PCA found that very effective ABHS solutions could be made with Triclosan also. For that reason PCA's ABHS contains Triclosan as a secondary active ingredient and also because it is substantive to skin. PCA found through actual human skin tests that Triclosan is biologically active even after washing once or twice with soap and water. Triclosan is effective against various microbes, including bacteria, fungi and yeasts.

Persons skilled in the art will readily understand that a variety of equivalent antimicrobial agents can be used as the active antimicrobial ingredient, such as Benzalkonium chloride, Chloroxylenol, Benzethonium chloride, and the like. It is within the purview of the instant invention to utilize an effective amount of any suitable antimicrobial formulation in formulations similar to that shown in the following non-limiting example, as illustrated in Table 1.

TABLE 1

| INGREDIENT | PURPOSE | %/WEIGHT |
|---|---|---|
| Ethyl Alcohol, 200 proof | Active biocidal agent | 60.0-70.0 |
| Triclosan | Active biocidal agent | 0.1-1.0 |
| Glycerin, 96-99% Sol. | Moisturizer | 1.0-10.0 |
| PEG-3 Caprylic/Capric Glycerides | Emollient | 1.0-10.0 |
| Tocopherol Acetate (Vitamin E) | Antioxidant | 0.1-1.0 |
| Fragrance | Fragrance | 0.1-1.0 |

In order to validate the effectiveness of the Ethyl Alcohol-Triclosan combination as an antibacterial agent, samples were tested by an independent testing laboratory with worldwide facilities. The Kill Time samples were tested according to the guidelines set forth in U.S. Pharmacopeia (51), Preservatives Effectiveness Challenge Test with the following modification. Total Bacterial Plate Counts were performed at 30 seconds after the inoculation phase to determine if the organisms were effectively eliminated from the product. Results of this antibacterial test is shown below in Table 2.

TABLE 2

| BACTERIA NAME | INITIAL ORGANISM COUNT* | 30 SECOND COUNT |
|---|---|---|
| *Staphylococcus aureus* ATCC#6538 | 1,000,000 | Est. < 10 |
| *Streptococcus pyogenes* ATCC#19615 | 1,000,000 | Est. < 10 |
| *Pseudomonas aeruginosa* ATCC#9027 | 1,000,000 | Est. < 10 |
| *Escherichia coli* | 1,000,000 | Est. < 10 |

Note:
*All counts reported as colony forming units per milliliter. Est. refers to actual plate counts not in the range of 25 to 250 colonies The organisms shown above are typical test organisms that are highly viable. *Staph. aureus* in its virulent stage can cause long term infections that can potentially result in death. *Esch. coli* (*E. coli*) is a common organism found in fecal matter that has been involved countless times with outbreaks of food infections. This is a prime example of the necessity for food handlers, or anyone else, to sanitize their hands after going to the toilet. The effectiveness of the instant ABHS solution can be seen above with a reduction of bacterial growth from 1.0 million to less that 10 organisms or 99.99% kill. Again, it cannot be over-emphasized that healthcare workers must sanitize their hands after touching their own skin, or even after such casual contact as a handshake with someone.

In one preferred embodiment, the actual pen nib 18 is a standard ball point pen that can be easily prepared to write. The pen nib is contained within the grip portion 26 of the writing instrument 10. The grip portion 26 has a generally tubular frusto-conical shape and includes a first apex end and a second base end. A simple rotation of the grip portion 26 of the barrel 22 displays or retracts the pen nib 18 through a nib opening 56 within the frusto-conically shaped grip portion 26. The pen barrel 22 preferably has an elongate tubular shape and includes a first end and a second end. The barrel has an outer diameter and a hollow interior having an inner diameter. The pen barrel measuring about 50 mm (2.00") contains the following: (a) Ball point, (b) Rotating mechanism to expose or retract the pen nib (not shown), and (c) Ink reservoir (not shown). Attached to the end of the 3 component unit, is the open barrel 22 that measures about 81.25 mm (3.25"). It is the open barrel that covers 80-85% of the 10 ml. liquid holding tank with its secured pump/actuator 24, 14. This then leaves exposed approximately 25 mm (1.07") that connected to the pump stem 30. The barrel also includes a clip element 58 which allows the device to be easily clipped to clothing or papers for storage and/or transport of the device. The complete ABHS_holding tank and pump unit, joined with the ball point pen unit described above is illustrated in FIGS. 1 and 2.

Alternative embodiments of the ABHS Writing Pen may include mechanical pencil components or a non-retractable pen nib, both of which are well known in the art.

Figure 2:
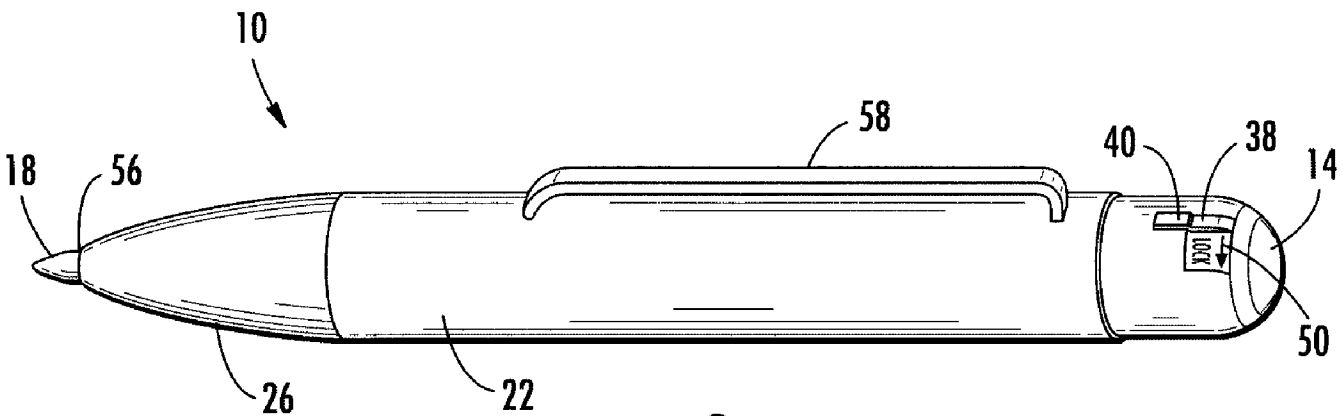
FIG. 2 is a rear view of the instant invention, illustrated with the twist-lock spray actuator in the unlocked position.

Now referring to FIG. 2, the back of the twist lock actuator 14 is shown. Note that the actuator will be embossed with arrows 50 to show the extreme right and left locked positions. The word "Lock" will be embossed to show the user how to lock the twist lock actuator.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An antimicrobial hand sanitizer and writing instrument comprising:

a barrel, said barrel having an elongated tubular shape including a first end, a second end, an outer diameter and a hollow interior having an inner diameter;

a grip portion, said grip portion having a generally tubular frusto-conical shape having a first apex end and a second base end, wherein said apex end includes a nib aperture, wherein said base end is constructed and arranged for securement to said first end of said barrel, wherein said grip portion is constructed and arranged to contain a writing instrument therein, wherein said writing instrument includes a nib and an ink reservoir, wherein said nib extends through said nib aperture;

a removable and replaceable solution cartridge secured within said inner diameter at said second end of said barrel, said solution cartridge positioned substantially within said barrel, said solution cartridge including a holding tank, said holding tank including a first closed end and a second open end, said open end being sealably closed by a finger pump, said finger pump including a dip tube, wherein said dip tube extends between said finger pump and said closed end of said holding tank, said finger pump including a twist-lock actuator, said twist-lock actuator rotatable between an operational position, wherein an antimicrobial hand solution may be dispensed, and at least one locked position, wherein said antimicrobial hand solution cannot be dispensed, said twist-lock actuator including a nozzle, said nozzle constructed and arranged to dispense said antimicrobial hand solution in an unencumbered manner upon depression of said twist-lock actuator.

2. The antimicrobial hand sanitizer and writing instrument in accordance with claim 1 wherein said grip portion is rotatably mounted with respect to said barrel, wherein rotation of said grip portion in a first direction extends said nib through said nib aperture to a writing position and wherein rotation of said grip portion in a second direction retracts said nib to a storage position within said grip portion.

3. The antimicrobial hand sanitizer and writing instrument in accordance with claim 1 wherein said holding tank is tapered, wherein said closed end of said holding tank is slightly smaller in diameter than said open end of said holding tank, wherein an outer surface of said holding tank frictionally engages said inner diameter of said barrel.

4. The antimicrobial hand sanitizer and writing instrument in accordance with claim 1 including an antimicrobial hand solution wherein said antimicrobial hand solution reduces bacterial growth by about 99.99%.

5. The antimicrobial hand sanitizer and writing instrument in accordance with claim 1 including an antimicrobial hand solution wherein said antimicrobial hand solution includes 60-70% alcohol by volume.

6. The antimicrobial hand sanitizer and writing instrument in accordance with claim 5 wherein said antimicrobial agent includes Triclosan.

7. The antimicrobial hand sanitizer and writing instrument in accordance with claim 5 wherein said antimicrobial hand solution includes an antimicrobial agent selected from the group consisting of Benzalkonium chloride, Chloroxylenol and Benzethonium chloride.

8. The antimicrobial hand sanitizer and writing instrument in accordance with claim 1 wherein said twist-lock actuator includes an outwardly extending key, wherein said finger pump includes a key-way;

whereby rotation of said twist-lock actuator to align said key with said keyway allows depression of said twist-lock actuator, whereby rotation of said twist-lock actuator to a position wherein said key does not align with said key-way prevents depression of said twist-lock actuator.

9. The antimicrobial hand sanitizer and writing instrument in accordance with claim 1 wherein said barrel includes a clip element, wherein said clip element permits said antimicrobial hand sanitizer and writing instrument to be secured to an article of clothing for storage.

10. An antimicrobial hand sanitizer and writing instrument comprising:

a barrel, said barrel having an elongated tubular shape including a first end, a second end, an outer diameter and a hollow interior having an inner diameter;

a grip portion, said grip portion having a generally tubular frusto-conical shape having a first apex end and a second base end, wherein said apex end includes a nib aperture, wherein said base end is constructed and arranged for securement to said first end of said barrel, wherein said grip portion is constructed and arranged to contain a writing instrument therein, wherein said writing instrument includes a nib and an ink reservoir, wherein said nib extends through said nib aperture;

a removable and replaceable solution cartridge secured within said inner diameter at said second end of said barrel, said solution cartridge positioned substantially within said barrel, said solution cartridge including a holding tank, said holding tank including a first closed end and a second open end, said open end being sealably closed by a finger pump, said finger pump including a dip tube, wherein said dip tube extends between said finger pump and said closed end of said holding tank, said finger pump including a twist-lock actuator, said twist-lock actuator rotatable between an operational position, wherein an antimicrobial hand solution may be dispensed, and at least one locked position, wherein said antimicrobial hand solution cannot be dispensed, said twist-lock actuator including a nozzle, said nozzle constructed and arranged to dispense said antimicrobial hand solution in an unencumbered manner upon depression of said twist-lock actuator;

an antimicrobial hand sanitizer contained within said holding tank, said antimicrobial hand solution capable of reducing bacterial growth by about 99.99%, said antimicrobial hand solution including a combination of alcohol and Triclosan, wherein said alcohol comprises about 60% of said solution by volume.

11. An antimicrobial hand sanitizer and writing instrument comprising:

a barrel, said barrel having an elongated tubular shape including a first end, a second end, an outer diameter and a hollow interior having an inner diameter;

a grip portion, said grip portion having a generally tubular frusto-conical shape having a first apex end and a second base end, wherein said apex end includes a nib aperture, wherein said base end is rotatably secured with respect to said first end of said barrel, wherein said grip portion is constructed and arranged to contain a writing instrument therein, wherein said writing instrument includes a nib and an ink reservoir, wherein rotation of said grip portion in a first direction extends said nib through said nib aperture to a writing position and wherein rotation of said grip portion in a second direction retracts said nib to a storage position within said grip portion;

a removable and replaceable solution cartridge secured within said inner diameter at said second end of said barrel, said solution cartridge positioned substantially within said barrel, said solution cartridge including a holding tank, said holding tank including a first closed end and a second open end, said open end being sealably closed by a finger pump, said finger pump including a dip tube, wherein said dip tube extends between said finger pump and said closed end of said holding tank, said finger pump including a twist-lock actuator, said twist-lock actuator rotatable between an operational position, wherein an antimicrobial hand solution may be dispensed, and at least one locked position, wherein said antimicrobial hand solution cannot be dispensed, said twist-lock actuator including a nozzle, said nozzle constructed and arranged to dispense said antimicrobial hand solution in an unencumbered manner upon depression of said twist-lock actuator;

an antimicrobial hand sanitizer contained within said holding tank, said antimicrobial hand solution capable of reducing bacterial growth by about 99.99%, said antimicrobial hand solution including a combination of alcohol and Triclosan, wherein said alcohol comprises about 60% of said solution by volume.

* * * * *